US006847471B2

(12) United States Patent
Chang

(10) Patent No.: US 6,847,471 B2
(45) Date of Patent: Jan. 25, 2005

(54) MULTIDIRECTIONALLY MOVABLE TRANSMISSION MECHANISM OF A BUSINESS MACHINE

(75) Inventor: Po-Wei Chang, Taipei (TW)

(73) Assignee: Kinpo Electronics, Inc., Taipei (TW)

( * ) Notice: Subject to any disclaimer, the term of this patent is extended or adjusted under 35 U.S.C. 154(b) by 488 days.

(21) Appl. No.: 10/103,285

(22) Filed: Mar. 22, 2002

(65) Prior Publication Data

US 2003/0179250 A1 Sep. 25, 2003

(51) Int. Cl.[7] ..... B41J 2/165

(52) U.S. Cl. ..... 358/1.9; 358/296; 358/502; 347/1; 347/9; 347/22; 347/29; 347/33; 347/34; 347/35

(58) Field of Search ..... 358/1.1, 1–9, 1.11–1.18, 358/296, 502; 347/1, 9, 20, 22, 29, 33, 34, 35, 67

(56) References Cited

U.S. PATENT DOCUMENTS 3,563,495 A * 2/1971 Korn ..... 244/3.29
3,690,527 A * 9/1972 Bustraan et al. ..... 225/4
3,808,772 A * 5/1974 Turschan ..... 53/141
3,984,061 A * 10/1976 Schreiber ..... 242/483.5
4,036,055 A * 7/1977 Engelhardt et al. ..... 73/312
4,459,017 A * 7/1984 Miura ..... 355/58

* cited by examiner

*Primary Examiner*—King Y. Poon
(74) *Attorney, Agent, or Firm*—Bacon &Thomas PLLC

(57) ABSTRACT

Multidirectionally movable transmission mechanism of a business machine, including a carrier defining therein a receiving space having channels, a control unit pivotally connectable in the receiving space and an operation unit operated by the carrier and the control unit. The control unit is a cylindrical bi-directional cam formed with a multidirectional guide groove designed with varied curvature and depth. In normal state, the operation unit is slidably inlaid in the guide groove and contacts with the bottom thereof. Under the guide of the guide groove with varied depths, the operation unit moves in a path perpendicular to the control unit. The operation unit includes an outward pushing member and a bracket. The outward pushing member has a rod body passing through the bracket which is freely slidably inlaid in the channels of the carrier. The bracket is guided by the channels to move in a path parallel to the control unit. By means of rotation of the control unit, the operation unit can be moved in directions of two coordinate axes.

13 Claims, 7 Drawing Sheets

MULTIDIRECTIONALLY MOVABLE TRANSMISSION MECHANISM OF A BUSINESS MACHINE

BACKGROUND OF THE INVENTION

The present invention is related to a multidirectionally movable transmission mechanism of a business machine. The transmission mechanism includes a control unit which is a cylindrical bi-directional cam formed with a multidirectional guide groove designed with varied tracks and depths. By means of rotation of the control unit, an operation unit can be moved in directions of two coordinate axes.

The transmission mechanism of a conventional business machine includes at least one linkage or cam mechanism and gear mechanism and connecting unit for connecting or operating the linkage or cam mechanism. The linkage or cam mechanism enables the transmission mechanism to axially or radially move.

One single linkage or cam mechanism can only control the moving path and speed of the transmission mechanism in one single direction. In the case that it is necessary to move the transmission mechanism in directions of at least two coordinate axes (such as X axis and Y axis), at least two linkages or cam mechanisms or a combination thereof must be used to achieve the bi-directional movement. As a result, the transmission mechanism of the conventional business machine will have complicated structure and much room of the machine will be occupied and the cost will be increased. Moreover, the connection between at least two linkages or cam mechanisms will lead to increased power consumption and error in transmission. Therefore, it is hard to accurately control the speed and acceleration of the transmission mechanism. Therefore, it is tried by the applicant to use fewer components to operate the transmission mechanism in directions of over two coordinate axes.

SUMMARY OF THE INVENTION

It is therefore a primary object of the present invention to provide a multidirectionally movable transmission mechanism of a business machine. The transmission mechanism includes a carrier a carrier, a control unit pivotally connectable in the carrier and an operation unit controlled and operated by the carrier and the control unit. The carrier defines therein a receiving space for receiving the control unit. Predetermined portions of the receiving space are formed with channels for connecting with the operation unit. The control unit is a cylindrical body which is pivotally connected in the receiving space of the carrier. The cylindrical body is formed with a guide groove preset with varied tracks and depths according to required moving path. The operation unit includes an outward pushing member and a bracket. One end of the outward pushing member passes through the bracket and keeps contacting with the bottom of the guide groove in normal state. The bracket is slidably inlaid in the channels of the carrier and guided thereby. Under the guide of the guide groove with varied depths, the outward pushing member of the operation unit moves in a path perpendicular to the control unit. The bracket is guided by the channels of the carrier to move in a path parallel to the control unit. By means of rotation of the control unit, the operation unit can be moved in directions of two coordinate axes. The structure of the transmission mechanism is simplified and the manufacturing cost is lowered and the energy consumption is reduced and the error is minimized. Also, the internal space of the machine is saved.

The present invention can be best understood through the following description and accompanying drawings wherein:

DETAILED DESCRIPTION OF THE PREFERRED EMBODIMENTS

Figure 1:
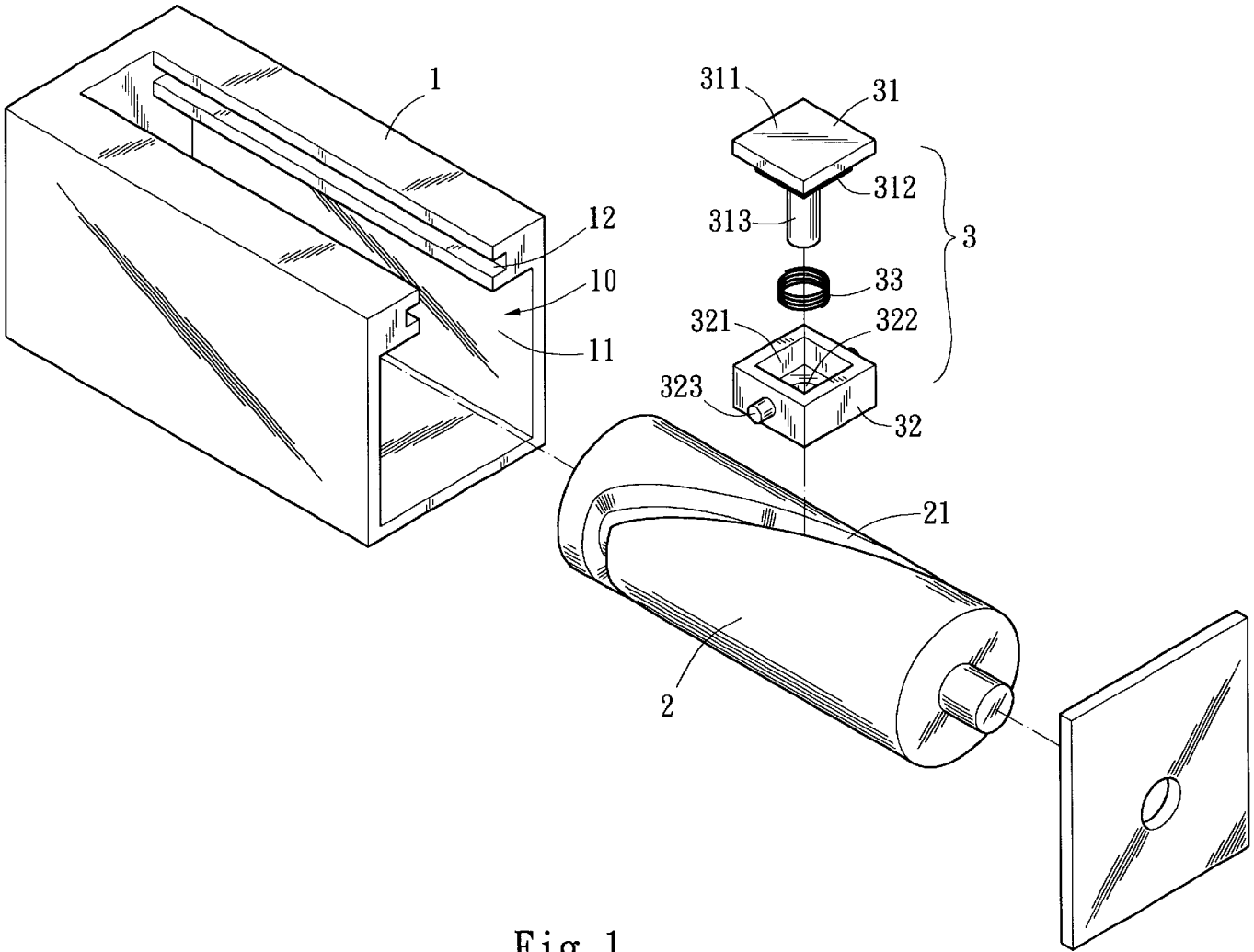
FIG. 1 is a perspective exploded view of the present invention.
Figure 2:
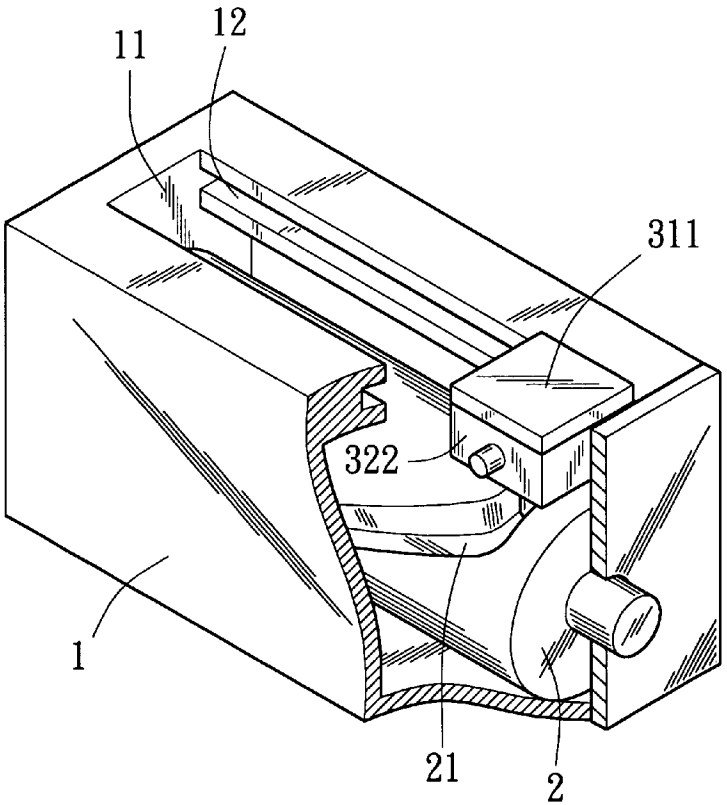
FIG. 2 is a perspective assembled view of the present invention.
Figure 3:
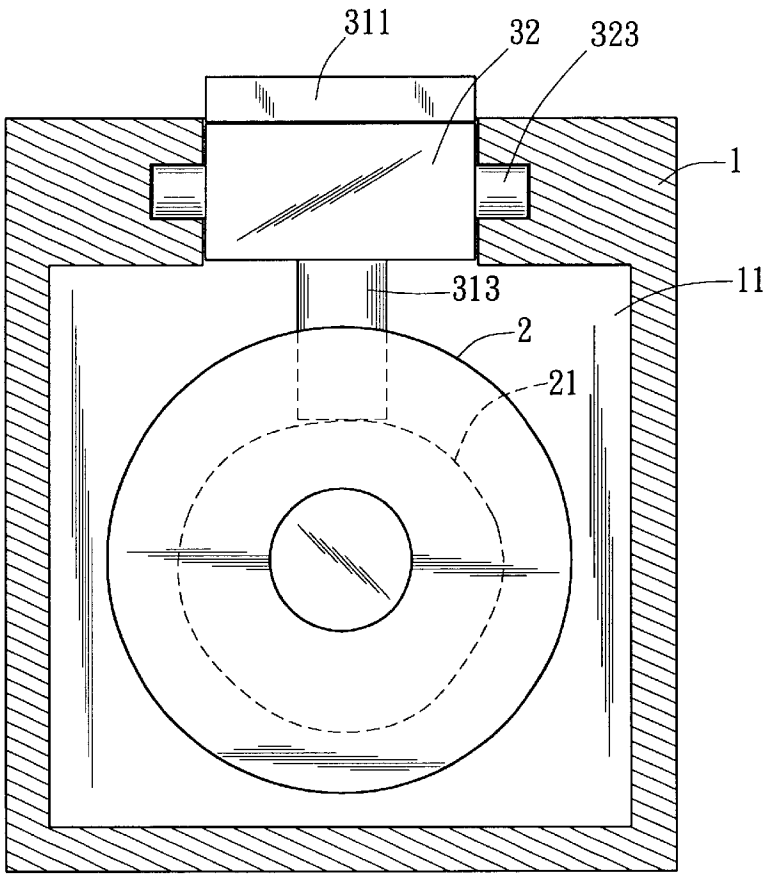
FIG. 3 is a cross-sectional view of the present invention.

Please refer to FIGS. 1 to 3. The transmission mechanism of the present invention includes a carrier 1, a control unit 2 pivotally connectable in the carrier 1 and an operation unit 3 controlled and operated by the carrier 1 and the control unit 2. The carrier 1 is a frame body having at least one open side 10. The carrier 1 defines therein a receiving space 11 for receiving the control unit 2. Channels are formed along two lateral edges of the open side 10, in which the operation unit 3 is slidably inlaid.

The control unit 2 is a substantially cylindrical body which can be pivotally connected in the receiving space 11 of the carrier 1. At least one pivot end of the control unit 2 extends out of the carrier 1 and is driven by a driving member (not shown) to rotate. The cylindrical body is formed with a guide groove 21 designed with varied curvature and depth according to set moving path. The track of the guide groove 21 guides the operation unit 3 and affects the moving speed thereof along the channels 12. The depth of the guide groove 21 guides the operation unit 3 to radially displace by different speed. The operation unit 3 has an outward pushing member 31 having a rod body 313. The bottom end of the rod body 313 in normal state keeps touching and pressing the bottom of the guide groove 21.

The operation unit 3 is composed of an outward pushing member 31 and a bracket 32. One end of the outward pushing member 31 is formed with stepped platform section 311 and bed section 312. The bottom face of the bed section 312 has a rod body 313. The bottom section of the rod body 313 passes through the bracket 32 and extends into the guide groove 21 to contact with the bottom thereof so as to ensure that the outward pushing member 31 can radially displace (Y axis) in accordance with different preset depths of the guide groove 21.

The bracket 32 is a frame body formed with an insertion cavity 321 corresponding to the bed section 312 of the outward pushing member 31 for accommodating the bed section 312 therein. The insertion cavity 321 is formed with a through hole 322 through which the rod body 313 extends into the guide groove 21. A pre-extended resilient member 33 is connected between the bracket 32 and the outward pushing member 31 for resiliently retracting the outward pushing member 31 into the insertion cavity 321 and ensuring that the rod body 313 in normal state contact with the bottom of the guide groove 21. Projecting members 323 are disposed on outer side of the frame body and freely slidably inlaid in the channels 12 of the carrier 1. The frame body can be guided by the channels 12 to move in a path in parallel to the channels 12. The outward pushing member 31 can be moved relative to the bracket 32 in a path perpendicular to the channels 12. By means of the control unit 2, the operation unit 3 can be multidirectionally moved.

The different depths of the guide groove 21 of the control unit 2 provide the moving path perpendicular to the channels 12. Cooperatively, the bracket 32 can move in parallel to the channels 12. Therefore, the moving paths in directions of two coordinate axes can be combined. In fact, the transmission mechanism is able to achieve at least bi-directional predetermined complex moving paths. Only one dimension of the control unit 2 (rotation about the axis) needs to be controlled for moving the operation unit 3 in the directions of two coordinate axes. According to actual requirements, the track and depth of the guide groove 21 can be set to accurately control the speed or acceleration of each travel. A machine for a certain object can be mounted on the platform section 311 of the outward pushing member 31 to do a predetermined work. The structure is simplified and the manufacturing cost is lowered and the energy consumption is reduced and the internal space of the machine is saved.

Figure 4:
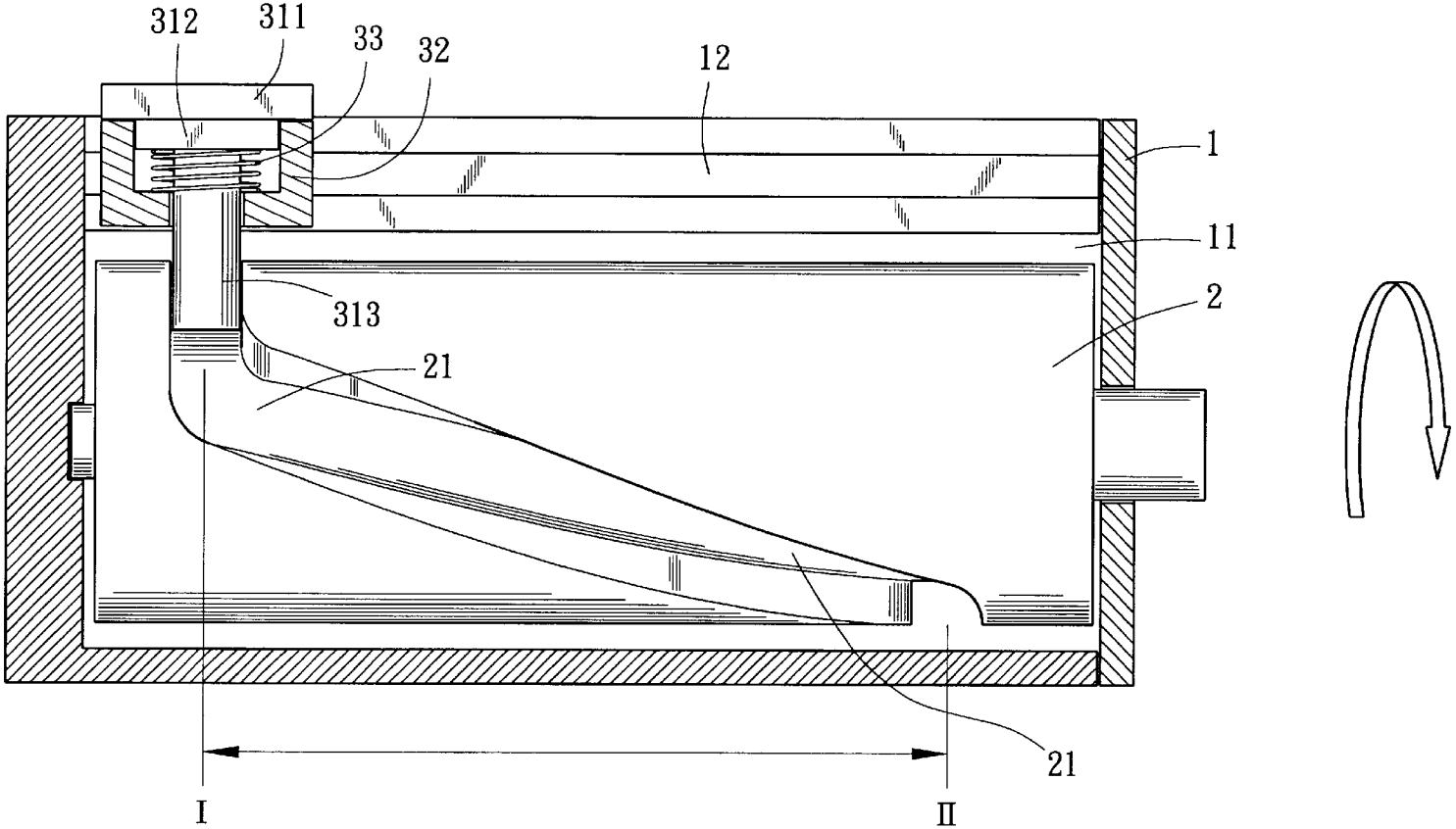
FIG. 4 shows that the present invention is positioned in position I.
Figure 5:
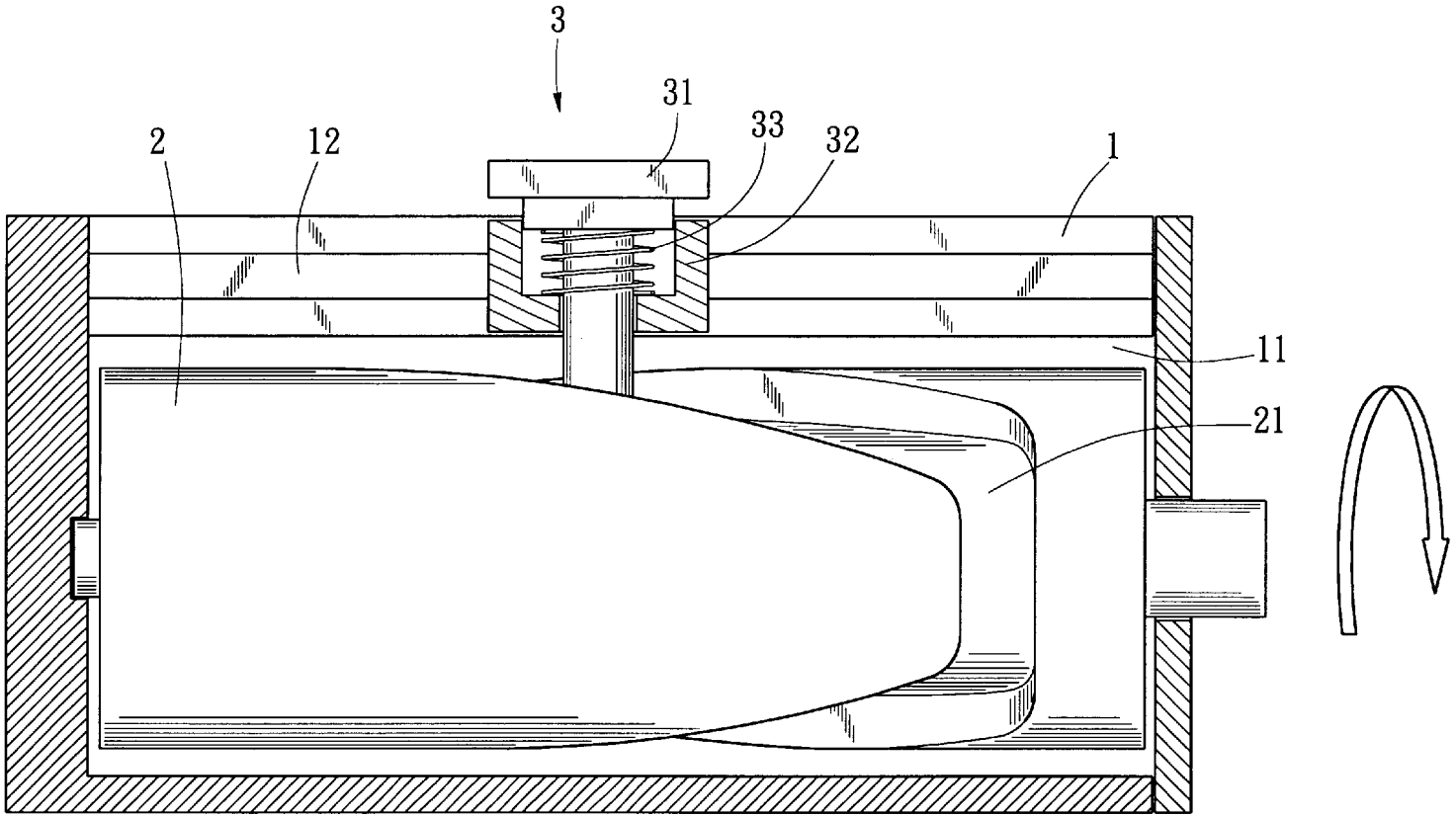
FIG. 5 shows that the present invention is positioned in position II.
Figure 6:
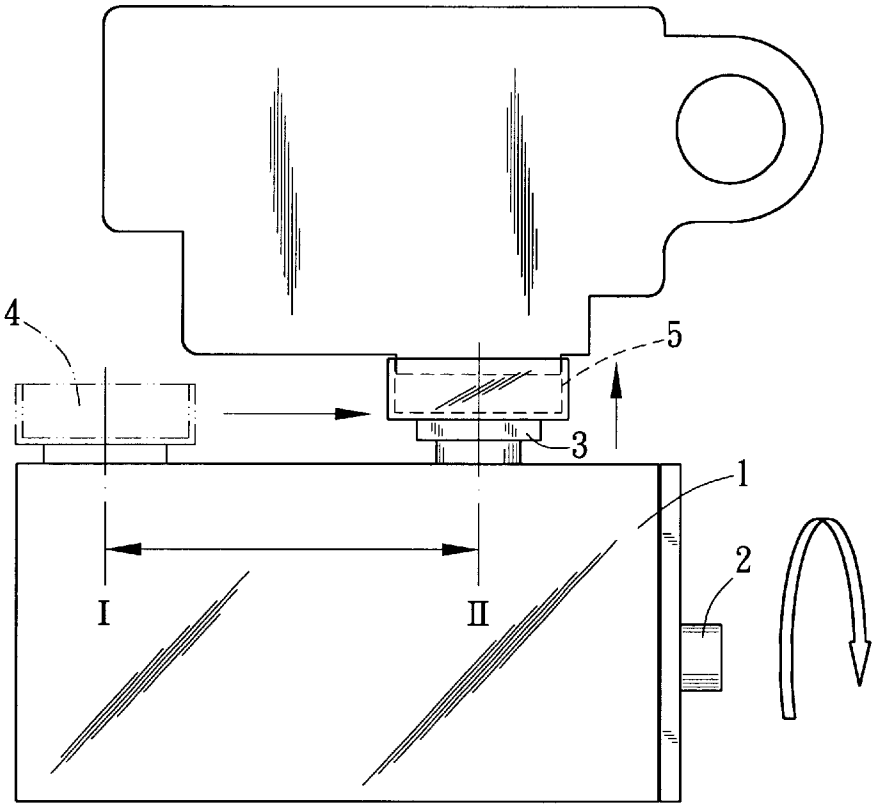
FIG. 6 shows the operation of the ink-injecting head and ink cover of the present invention.

Referring to FIGS. 4 to 6, the present invention is applied to the transmission mechanism of a cover body of ink-injecting head of a printer. An ink cover 4 is added onto the platform section 311 of the outward pushing member 31. When the control unit 2 is rotated, the bottom end of the rod body 313 of the outward pushing member 31 is moved along the set path of the guide groove 21. At this time, the operation unit 3 is moved in directions of at least two coordinate axes. As shown in FIGS. 4 and 5, the operation unit 3 is guided by the guide groove 21 and moved from position I to position II. FIG. 6 shows that in not used state, the ink-injecting head 5 is positioned on upper side of the control unit 2. By means of the operation of the operation unit 3, the ink cover 4 is moved along horizontal axis from position I where the groove is deeper to position II where the groove is shallower. When moving to position II where the guide groove 21 is shallower, the outward pushing member 31 is pushed and gradually vertically lifted until the ink-injecting head 5 is totally covered by the ink cover 4. Therefore, in not used state, the ink-injecting head 5 is prevented from drying and being blocked.

Figure 7:
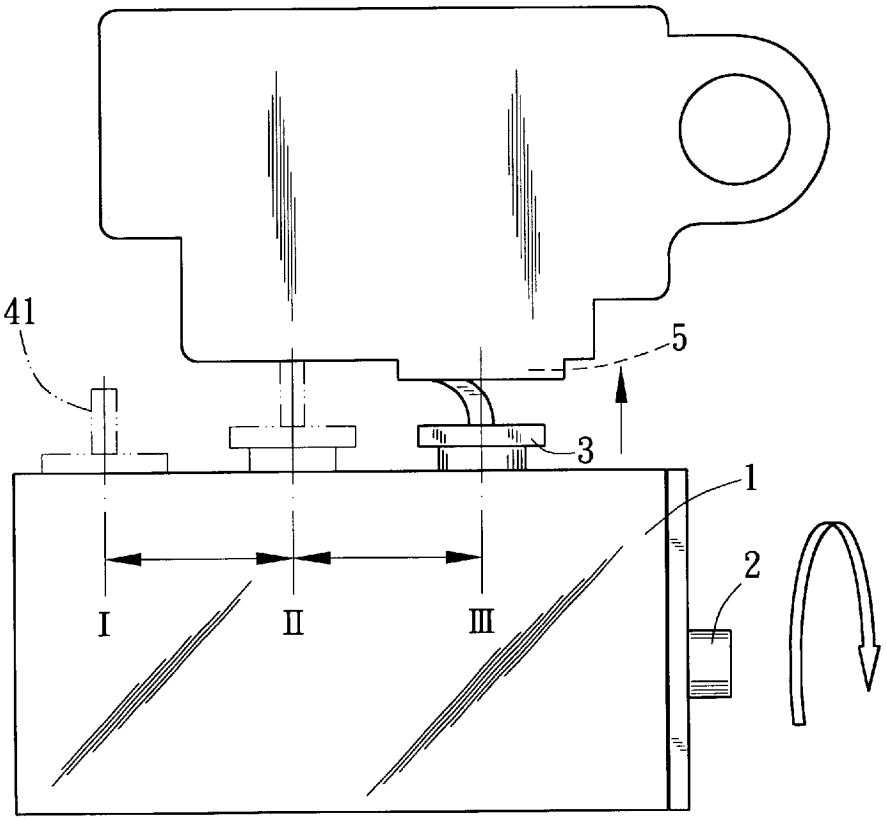
FIG. 7 shows the operation of the ink-injecting head and ink-wiping member of the present invention.

FIG. 7 shows another embodiment of the present invention which is applied to the transmission mechanism of an ink-wiper. An ink-wiping member 41 is mounted on the platform section 311 of the outward pushing member 31. When the control unit 2 is rotated, the bottom end of the rod body 313 of the outward pushing member 31 is moved along the guide groove 21 from position I where the groove is deeper to position II where the groove is shallower. At this time, the rod body 313 of the outward pushing member 31 is pushed and gradually vertically lifted into an ink-wiping area. Position II and position III are designed with equal depths, whereby when the operation unit 3 is moved to position III, the excessive ink on the ink-injecting head can be fully wiped off so as to ensure successive printing quality.

The above embodiments are only used to illustrate the present invention, not intended to limit the scope thereof. Many modifications of the above embodiments can be made without departing from the spirit of the present invention.

What is claimed is:

1. Multidirectionally movable transmission mechanism of a business machine, comprising a carrier, a control unit pivotally connectable in the carrier and an operation unit controlled and operated by the carrier and the control unit, wherein:

the carrier defines therein a receiving space for receiving the control unit, predetermined portions of the receiving space being formed with channels for connecting with the operation unit;

the control unit is a cylindrical body which is pivotally connected in the receiving space of the carrier, at least one pivot end of the control unit extending out of the carrier and being driven by a driving member to rotate, the cylindrical body being formed with a guide groove preset with varied tracks and depths according to required moving path; and the operation unit includes an outward pushing member and a bracket, one end of the outward pushing member passing through the bracket and keeping contacting with the bottom of the guide groove in normal state, the bracket being slidably inlaid in the channels of the carrier and guided thereby, whereby by means of operation in one single dimension, the outward pushing member can be moved in complex directions parallel to and perpendicular to the channels.

2. Multidirectionally movable transmission mechanism of a business machine as claimed in claim 1, wherein the carrier is a frame body having at least one open side, the carrier defining therein a receiving space for receiving the control unit, channels being formed along two lateral edges of the open side of the carrier, in which the operation unit is slidably inlaid.

3. Multidirectionally movable transmission mechanism of a business machine as claimed in claim 1, wherein one end of the outward pushing member is formed with stepped platform section and bed section, the bottom face of the bed section having a rod body, the bottom section of the rod body passing through the bracket and extending into the guide groove to contact with the bottom thereof so as to ensure that the outward pushing member can radially displace in accordance with different preset depths of the guide groove.

4. Multidirectionally movable transmission mechanism of a business machine as claimed in claim 1, wherein the bracket is a frame body formed with an insertion cavity corresponding to the bed section of the outward pushing member for accommodating the bed section therein, the insertion cavity being formed with a through hole through which the rod body extends into the guide groove.

5. Multidirectionally movable transmission mechanism of a business machine as claimed in claim 3, wherein the bracket is a frame body formed with an insertion cavity corresponding to the bed section of the outward pushing member for accommodating the bed section therein, the insertion cavity being formed with a through hole through which the rod body extends into the guide groove.

6. Multidirectionally movable transmission mechanism of a business machine as claimed in claim 1, wherein a pre-extended resilient member is connected between the bracket and the outward pushing member for resiliently retracting the outward pushing member into the insertion cavity and ensuring that the rod body in normal state contact with the bottom of the guide groove.

7. Multidirectionally movable transmission mechanism of a business machine as claimed in claim 3, wherein a pre-extended resilient member is connected between the bracket and the outward pushing member for resiliently retracting the outward pushing member into the insertion cavity and ensuring that the rod body in normal state contact with the bottom of the guide groove.

8. Multidirectionally movable transmission mechanism of a business machine as claimed in claim 1, wherein projecting members are disposed on outer side of the bracket and freely slidably inlaid in the channels of the carrier.

9. Multidirectionally movable transmission mechanism of a business machine as claimed in claim 3, wherein projecting members are disposed on outer side of the bracket and freely slidably inlaid in the channels of the carrier.

10. Multidirectionally movable transmission mechanism of a business machine as claimed in claim 1, wherein an ink cover is added onto the platform section of the outward pushing member.

11. Multidirectionally movable transmission mechanism of a business machine as claimed in claim 3, wherein an ink cover is added onto the platform section of the outward pushing member.

12. Multidirectionally movable transmission mechanism of a business machine as claimed in claim 1, wherein an ink-wiping member is added onto the platform section of the outward pushing member.

13. Multidirectionally movable transmission mechanism of a business machine as claimed in claim 3, wherein an ink-wiping member is added onto the platform section of the outward pushing member.

* * * * *